US009284031B1

(12) United States Patent
Pelini

(10) Patent No.: US 9,284,031 B1
(45) Date of Patent: Mar. 15, 2016

(54) EXTENDING JACK PLATE

(71) Applicant: Mark F. Pelini, Valrico, FL (US)

(72) Inventor: Mark F. Pelini, Valrico, FL (US)

( * ) Notice: Subject to any disclaimer, the term of this patent is extended or adjusted under 35 U.S.C. 154(b) by 456 days.

(21) Appl. No.: 13/966,314

(22) Filed: Aug. 14, 2013

(51) Int. Cl.
*B63H 5/125* (2006.01)
*B63H 20/06* (2006.01)
*B63H 20/16* (2006.01)

(52) U.S. Cl.
CPC ..... *B63H 20/06* (2013.01); *B63H 5/125* (2013.01); *B63H 20/16* (2013.01)

(58) Field of Classification Search
CPC ..... B63H 5/125; B63H 20/10; B63H 20/08; B63H 20/16
USPC ..... 248/640; 440/53, 54, 59, 61 E
See application file for complete search history.

(56) References Cited

U.S. PATENT DOCUMENTS

| | | | | |
|---|---|---|---|---|
| 3,242,899 | A | 3/1966 | Hanson | |
| 4,624,438 | A | 11/1986 | Goodman | |
| 5,100,349 | A | 3/1992 | Perkins | |
| 5,704,308 | A | 1/1998 | Anderson | |
| 5,782,662 | A | 7/1998 | Icenogle | |
| 6,126,498 | A | 10/2000 | Icenogle | |
| 6,890,227 | B1 | 5/2005 | Alby | |
| 7,416,459 | B1 * | 8/2008 | Pelini | B63H 20/106 440/61 R |
| 7,527,539 | B1 * | 5/2009 | Pelini | B63H 20/08 440/61 R |
| 7,731,552 | B1 * | 6/2010 | Pelini | B63H 20/06 440/53 |
| D622,287 | S | 8/2010 | Pelini | |
| 8,210,886 | B1 | 7/2012 | Pelini | |
| 8,235,174 | B1 * | 8/2012 | Pelini | E06C 1/381 114/362 |
| 8,511,430 | B1 * | 8/2013 | Pelini | B63B 27/146 114/362 |
| 8,535,105 | B1 * | 9/2013 | Pelini | B63H 20/02 440/61 E |
| 9,004,962 | B1 * | 4/2015 | Pelini | B63H 20/10 440/61 D |

* cited by examiner

*Primary Examiner* — Todd M Epps
(74) *Attorney, Agent, or Firm* — Edward P Dutkiewicz

(57) ABSTRACT

There is described an extending jack plate, comprising several components, in combination. There is a right transom mounting bracket and a left transom mounting bracket. There is a right slide mounting bracket and a left slide mounting bracket slidably coupled to the right and left transom mounting brackets. A slide plate is slidably coupled to the right and a left slide mounting brackets. Adjustment blocks and adjustment rods provide forward and rearward adjustment.

21 Claims, 4 Drawing Sheets

FIG. 3
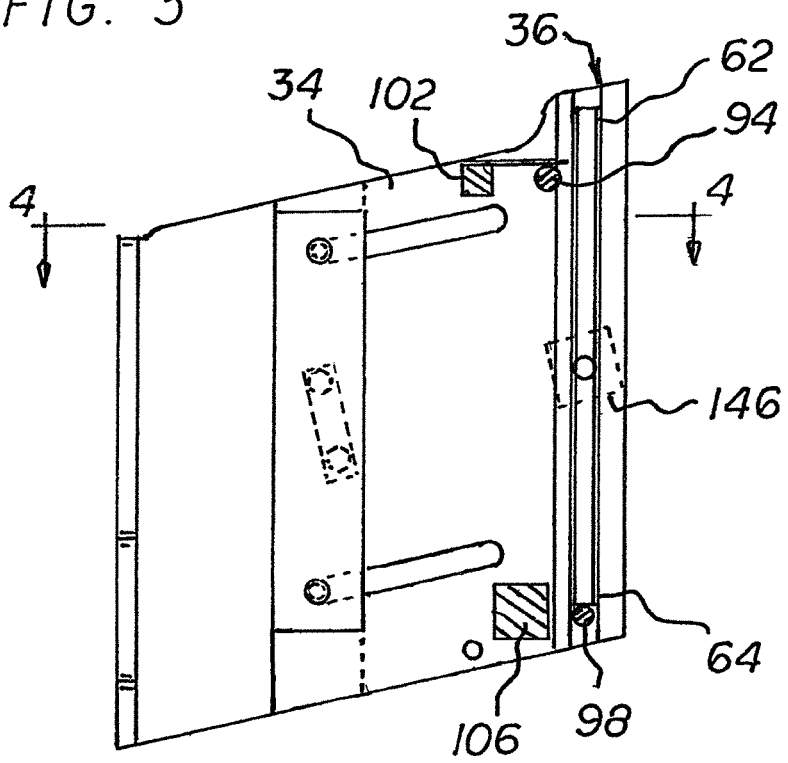
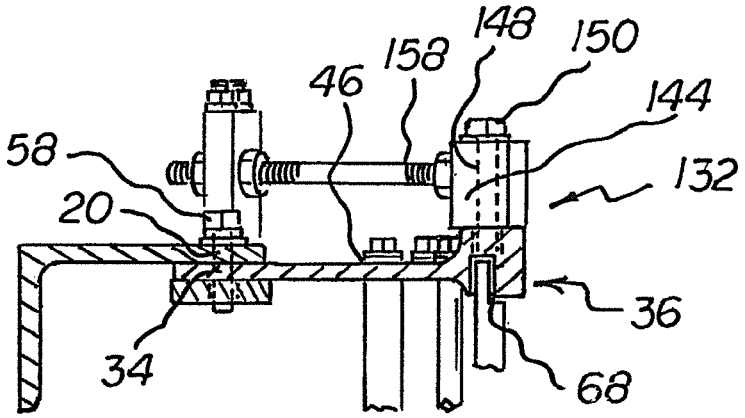
FIG. 4

EXTENDING JACK PLATE

RULE 1.78(F)(1) DISCLOSURE

The Applicant has not submitted a related pending or patented non-provisional application within two months of the filing date of this present application. The invention is made by a single inventor, so there are no other inventors to be disclosed. This application is not under assignment to any other person or entity at this time.

BACKGROUND OF THE INVENTION

1. Field of the Invention

The present invention relates to a extending jack plate and more particularly pertains to a jack plate which can be extended away from a boat's hull and transom.

2. Description of the Prior Art

The use of jack plates is known in the prior art. More specifically, jack plates previously devised and utilized for the purpose of positioning an outboard motor relative to the boat's hull and transom are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the prior art does not describe extending jack plate that allows a jack plate to be extended away from a boat's hull and transom.

In this respect, the extending jack plate, according to the present invention, substantially departs from the conventional concepts and designs of the prior art, and in doing so provides an apparatus primarily developed for the purpose of a having the capability of extending a jack plate away from a boat's hull and transom.

Therefore, it can be appreciated that there exists a continuing need for a new and improved extending jack plate which can be used for extending a motor's location away from a boat's hull and transom. In this regard, the present invention substantially fulfills this need.

SUMMARY OF THE INVENTION

In view of the foregoing disadvantages inherent in the known types of jack plates now present in the prior art, the present invention provides an improved extending jack plate. As such, the general purpose of the present invention, which will be described subsequently in greater detail, is to provide a new and improved extending jack plate which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

By the term "adjacent to" a structure is meant that the location is near the identified structure.

To attain the desirable features, the present invention essentially comprises an extending jack plate, as is herein described. The extending jack plate comprises several components, in combination.

There is a right transom mounting bracket and a left transom mounting bracket. Each transom mounting bracket has a generally L-shaped configuration. Each transom mounting bracket is an approximate mirror image of the other. Each transom mounting bracket has an inwardly disposed transom contact portion and each transom mounting bracket has a rearwardly disposed slide plate mount coupling portion. Each slide plate mount coupling portion has a plurality of slide lock bolt holes there through. Each slide plate mount coupling portion has a plurality of stepped forward adjustment block mounting bolt holes therein. Each slide plate mount coupling portion has a rearward extent.

There is a right slide mounting bracket and a left slide mounting bracket. Each slide mounting bracket has a forwardly disposed portion. Each slide mounting bracket has a rearwardly disposed terminus. Each slide mounting bracket is an approximate mirror image of the other.

The forwardly disposed portion of each of the slide mounting brackets has a generally rectilinear configuration with a plurality of slide slots therethrough. Each of the forwardly disposed portions of each of the slide mounting brackets has an upper forward cross member bolt hole there through, an upper rearward cross member bolt hole there through, a lower forward cross member bolt hole there through, and a lower rearward cross member bolt hole there through.

The rearwardly disposed terminus of each of the slide mounting brackets is a generally mirror image of the other. Each terminus of the slide mounting brackets has a slide plate groove therein.

Each slide plate groove has an associated nylon groove insert therein. The groove insert has a generally C-shaped configuration.

Each insert has a grease hole there through. The terminus of each of the slide mounting brackets has a threaded rearward adjustment block mounting hole therein. Each terminus of the slide mounting brackets has at least one threaded grease fitting hole therethrough, with an associated grease fitting threadedly coupled thereto.

There is a pair of right slide bolts which slidably couple the right transom mounting bracket and the right slide mounting bracket.

There is a pair of left slide bolts which slidably couple the left transom mounting bracket and the left slide mounting bracket.

The plurality of slide bolts slidably couples the right transom mounting bracket and the right slide mounting bracket, the plurality of slide bolts also slidably couples the left transom mounting bracket and the left slide mounting bracket.

There is a slide plate. The slide plate has a rectilinear configuration. The slide plate has a top edge, a bottom edge, and a pair of side edges. The side edges of the slide plate each have a stepped configuration. The slide plate has a pair of ram bracket holes therethrough, with the ram bracket holes being located generally midway between the side edges. The ram bracket holes are also adjacent the top edge of the slide plate.

The slide plate having a plurality of motor mount bolt holes there through. The side edges of the slide plate are sized to fit within the nylon groove insert. The slide plate has an associated lift distance marker. The lift distance marker has a plurality of indicia thereon. The slide plate has a pair of slide plate stop bolt holes therethrough.

There is a slide plate stop. The slide plate stop has a generally rectilinear configuration with a top surface and a bottom surface, with a height there between. The slide plate stop has a pair of side surfaces with a thickness there between. The slide plate stop has a forward surface and a rearward surface, with a length there between. The rearward surface of the slide plate stop has a pair of threaded bolt holes therein. The slide plate stop has a pair of associated slide plate stop bolts. The slide plate stop bolts couple the slide plate stop to the slide plate.

There is an upper rearward cross member. The upper rearward cross member has a generally round solid tubular configuration with a right end and a left end. The right end of the upper rearward cross member and the left end of the upper rearward cross member each have a threaded bolt hole therein, with each end of the upper rearward cross member having an associated bolt. The upper rearward cross member fixedly couples the right slide mounting bracket and the left slide mounting bracket.

There is a lower rearward cross member. The lower rearward cross member has a generally round solid tubular configuration, with a right end and a left end. The right end of the lower rearward cross member and the left end of the lower rearward cross member each have a threaded bolt hole therein, with each end of the lower rearward cross member having an associated bolt. The lower rearward cross member fixedly couples the right slide mounting bracket and the left slide mounting bracket.

There is an upper forward cross member. The upper forward cross member has a generally rectangular solid tubular configuration with a right end and a left end. The right end of the upper forward cross member and the left end of the upper forward cross member each have a threaded bolt hole therein, with each end of the upper forward cross member having an associated bolt. The upper forward cross member fixedly couples the right slide mounting bracket and the left slide mounting bracket.

There is a lower forward cross member. The lower forward cross member has a generally rectangular solid tubular configuration with a right end and a left end. The right end of the lower forward cross member and the left end of the lower forward cross member each have a threaded bolt hole therein, with each end of the lower forward cross member having an associated bolt. The lower forward cross member fixedly couples the right slide mounting bracket and the left slide mounting bracket. The lower forward cross member has a hydraulic cylinder base mounting hole there through.

There is a right forward adjustment block and a left forward adjustment block. Each forward adjustment block has a generally solid rectangular configuration with an inward side, an outward side, a forward side, a rearward side, a top side, and a bottom side. Each of the forward adjustment blocks has a pair of bolt holes running from the inward side to the outward side. Each bolt hole has an associated bolt coupling each of the forward adjustment blocks to one of the transom mounting brackets. Each forward adjustment block has an aperture running from the forward side to the rearward side.

There is a right rearward adjustment block and a left rearward adjustment block. Each rearward adjustment block has a generally solid rectangular configuration with an inward side, an outward side, a forward side a rearward side, a top side, and a bottom side. Each of the rearward adjustment blocks has a bolt hole running from the inward side to the outward side therethrough with the bolt hole having an associated bolt coupling each of the rearward adjustment blocks to one of the terminus of each of the slide plate mounting brackets. Each rearward adjustment block has a threaded bolt hole in the forward side.

There is a right adjustment rod and a left adjustment rod. Each adjustment rod has a first threaded end, with the first threaded end of each adjustment rod being sized to be threadedly mated with and received by the threaded bolt hole of each of the rearward adjustment blocks. The first threaded end of each adjustment rod has an associated lock nut. The right adjustment rod and the left adjustment rod each have a second threaded end. The threaded second end of each adjustment rod is sized to slidably pass through the aperture of each of the forward adjustment blocks. The second end of each adjustment rod has a pair of associated lock nuts. The right adjustment rod operatively couples the right rearward adjustment block and the right forward adjustment block. The left adjustment rod operatively couples the left rearward adjustment block and the left forward adjustment block. Each adjustment rod has a length between the first end and the second end.

There is a hydraulic ram bracket having a generally C-shaped configuration. The ram bracket has a rearward portion and a pair of generally parallel side portions. The side portions of the ram bracket each have a ram pin hole there through. The rearward portion of the ram bracket has a pair of bolt holes there through, with a pair of associated bolts. The ram bracket is coupled to the slide plate.

Lastly, there is a hydraulic cylinder. The hydraulic cylinder has a base and a ram. The hydraulic cylinder base is operatively coupled to the lower forward cross member. The hydraulic ram is operatively coupled to the hydraulic ram bracket and the slide plate.

There has, thus, been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved extending jack plate which has all of the advantages of the prior art jack plates and none of the disadvantages.

It is another object of the present invention to provide a new and improved extending jack plate which may be easily and efficiently manufactured and marketed.

It is further object of the present invention to provide a new and improved extending jack plate which is of durable and reliable constructions.

An even further object of the present invention is to provide a new and improved extending jack plate which is susceptible of a low cost of manufacture with regard to both materials and labor, and which accordingly is then susceptible of low prices of sale to the consuming public, thereby making such extending jack plate economically available to the buying public.

Even still another object of the present invention is to provide an extending jack plate which can be extended away from a boat's hull and transom.

Lastly, it is an object of the present invention to provide a new and improved extending jack plate, comprising several components, in combination. There is a right transom mounting bracket and a left transom mounting bracket. There is a right slide mounting bracket and a left slide mounting bracket slidably coupled to the right and left transom mounting brackets. A slide plate is slidably coupled to the right and a left slide mounting brackets. Adjustment blocks and adjustment rods provide forward and rearward adjustment.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a view taken along line 3-3 of FIG. 2.

FIG. 4 is a view taken along line 4-4 of FIG. 3.

The same reference numerals refer to the same parts throughout the various Figures.

DESCRIPTION OF THE PREFERRED EMBODIMENT

Figure 1:
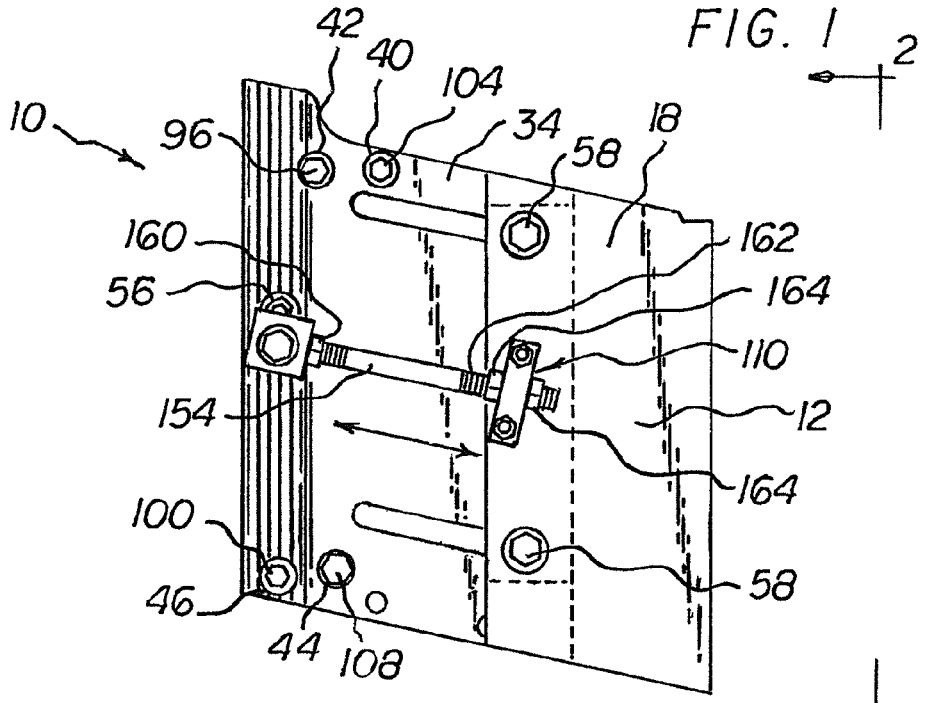
FIG. 1 is a right side elevational view of the jack plate in the extended position. Note the adjustment rod connecting the rearward adjustment block and the forward adjustment block.
Figure 2:
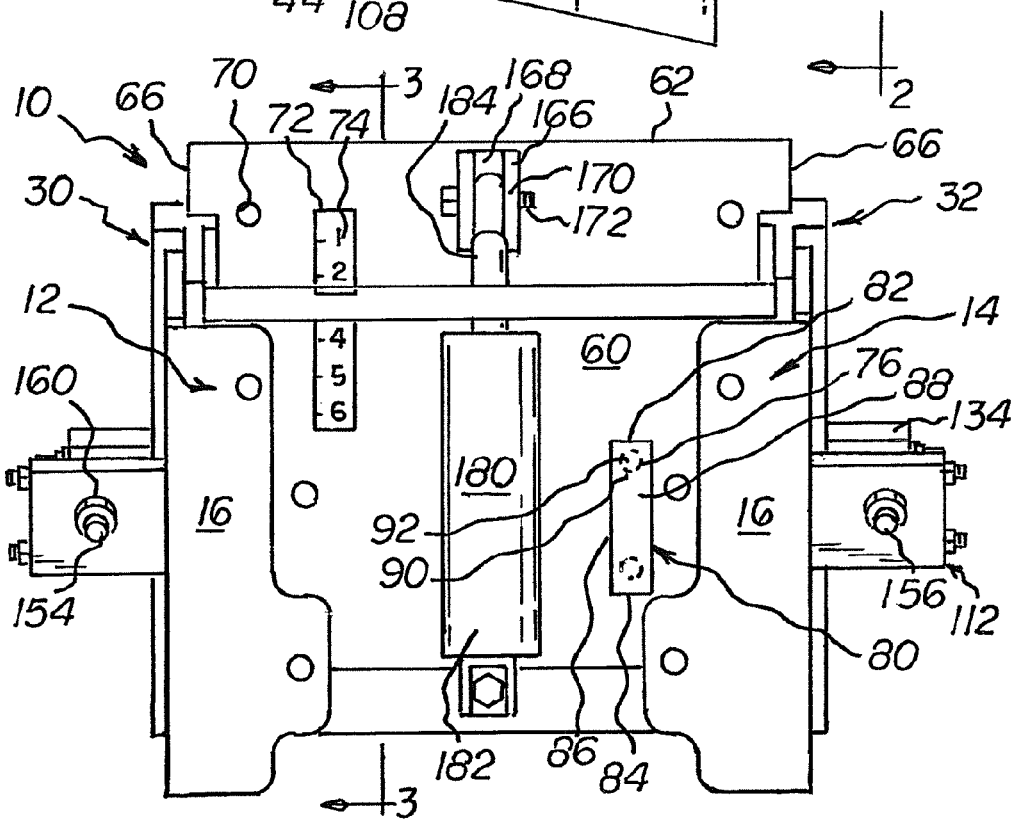
FIG. 2 is a view taken along line 2-2 of FIG. 1. This is a view from a transom of a boat, looking rearward.
Figure 5:
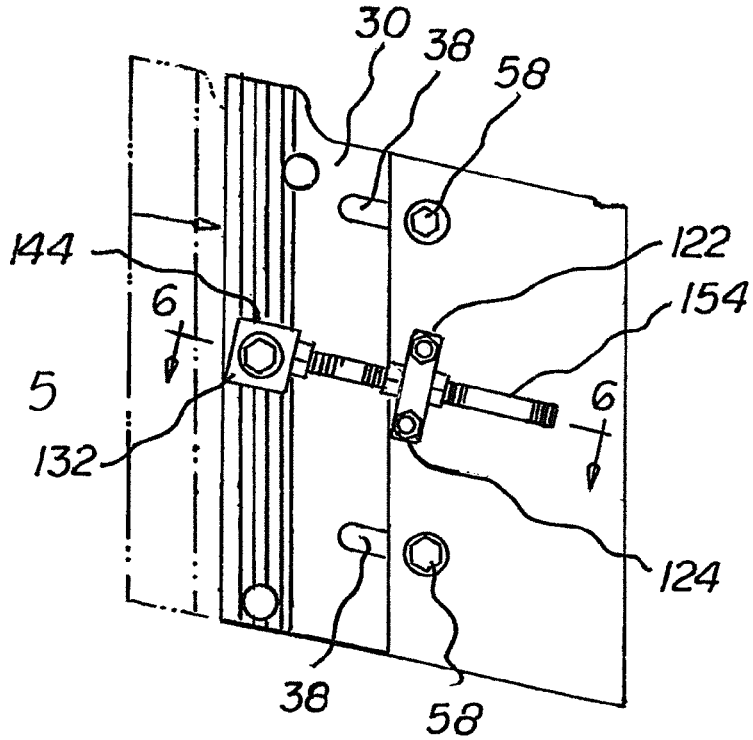
FIG. 5 is a right side elevational view of the jack plate in the drawn in position.
Figure 6:
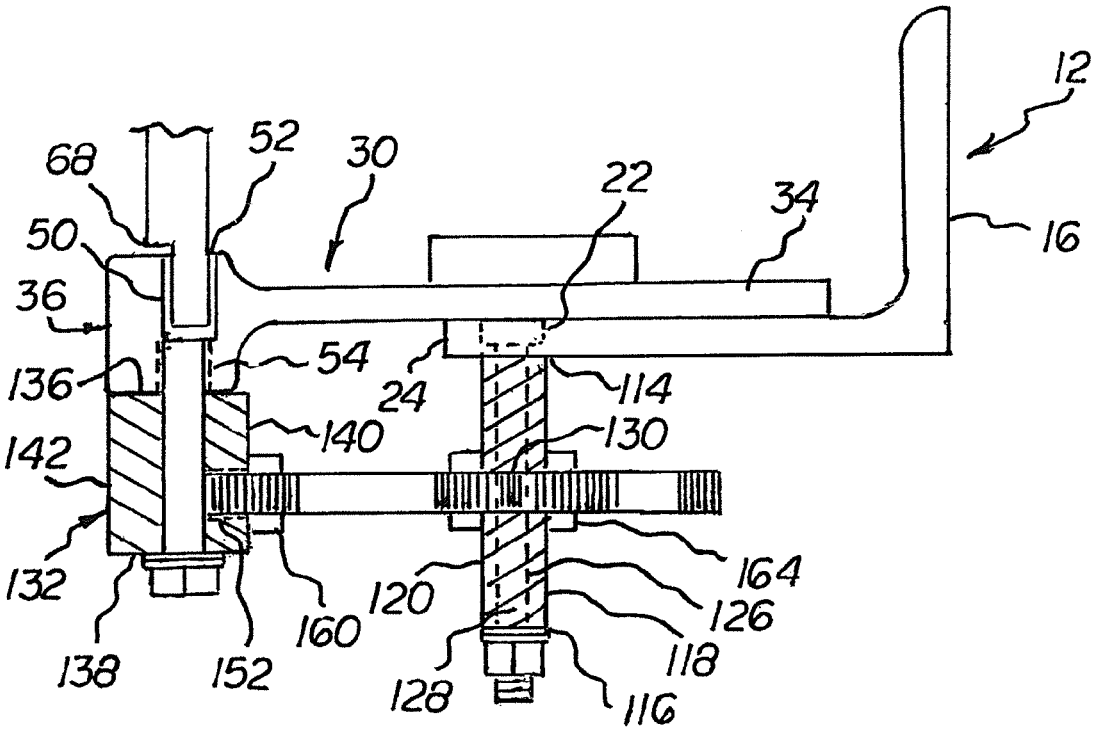
FIG. 6 is a view taken along line 6-6 of FIG. 5.
Figure 7:
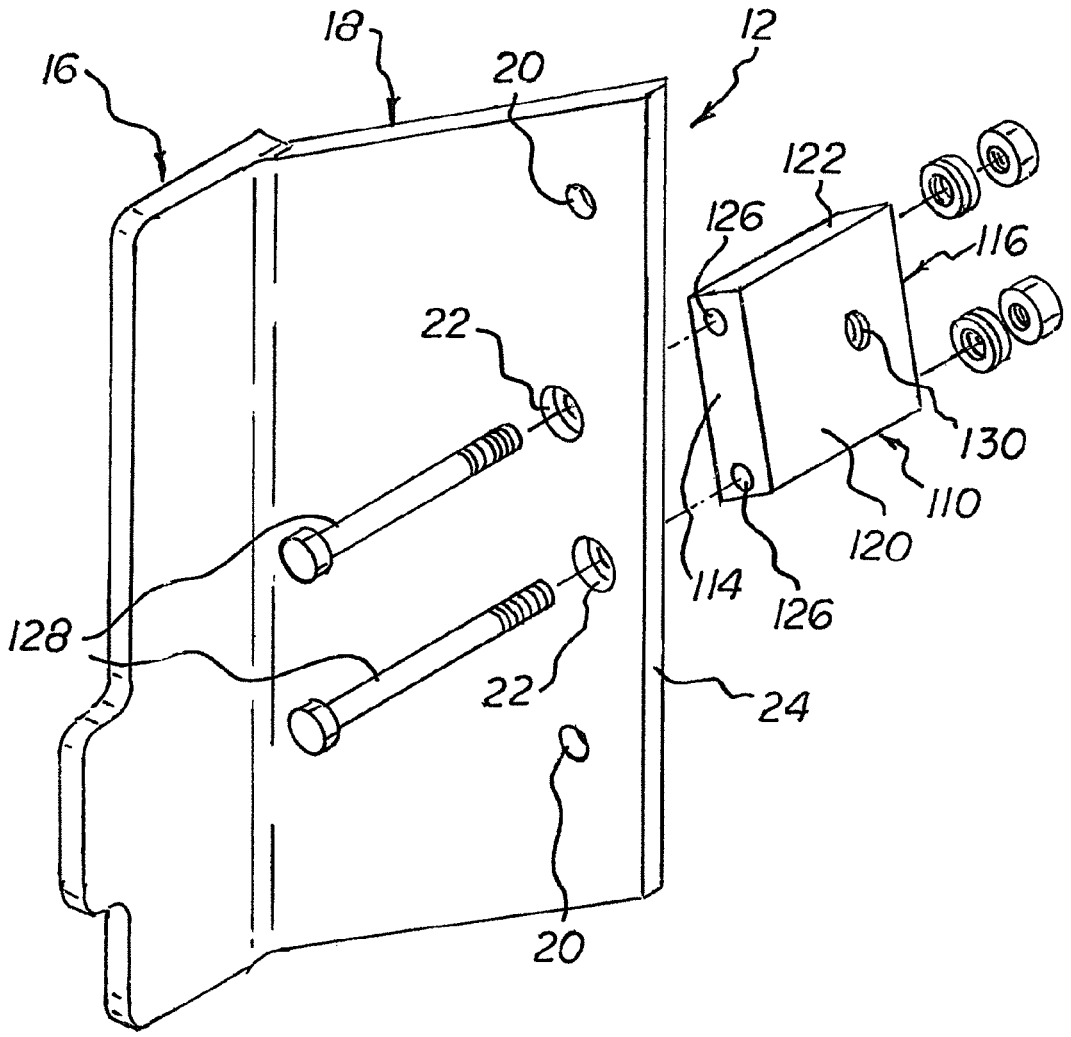
FIG. 7 is an exploded view of the right transom mounting bracket showing the right forward adjustment block.

With reference now to the drawings, and in particular to FIG. 1 thereof, the preferred embodiment of the new and improved extending jack plate embodying the principles and concepts of the present invention and generally designated by the reference numeral 10 will be described.

The present invention, the extending jack plate 10 is comprised of a plurality of components. Such components in their broadest context include a pair of mounting brackets, a pair of slide mounting brackets, a slide plate, adjusting blocks, and a pair of adjustment rods. Such components are individually configured and correlated with respect to each other so as to attain the desired objective.

An extending jack plate 10 is herein described. The extending jack plate comprises several components, in combination.

There is a right transom mounting bracket 12 and a left transom mounting bracket 14. In describing left and right, forward and rearward, the reference point is taken from a person standing behind a boat with the extending jack plate mounted on a transom of the boat.

Each transom mounting bracket has a generally L-shaped configuration. Each transom mounting bracket is an approximate mirror image of the other. Each transom mounting bracket has an inwardly disposed transom contact portion 16 and each transom mounting bracket has a rearwardly disposed slide plate mount coupling portion 18. Each slide plate mount coupling portion has a plurality of slide lock bolt holes 20 there through. Each slide plate mount coupling portion has a plurality of stepped forward adjustment block mounting bolt holes 22 therein. Each slide plate mount coupling portion has a rearward extent 24. Each transom mounting bracket inwardly disposed transom contact portion has a plurality of transom mounting bolt holes therethrough for fixedly attaching the mounting bracket to a boat transom (not shown).

There is a right slide mounting bracket 30 and a left slide mounting bracket 32. Each slide mounting bracket has a forwardly disposed portion 34. Each slide mounting bracket has a rearwardly disposed terminus 36. Each slide mounting bracket is an approximate mirror image of the other.

The forwardly disposed portion of each of the slide mounting brackets has a generally rectilinear configuration with a plurality of slide slots 38 therethrough. Each of the forwardly disposed portions of each of the slide mounting brackets has an upper forward cross member bolt hole 40 therethrough, an upper rearward cross member bolt hole 42 therethrough, a lower forward cross member bolt hole 44 therethrough, and a lower rearward cross member bolt hole 46 therethrough.

The rearwardly disposed terminus of each of the slide mounting brackets is a generally mirror image of the other. Each terminus of the slide mounting brackets has a slide plate groove 50 therein.

Each slide plate groove has an associated nylon groove insert therein. The groove insert has a generally C-shaped configuration.

Each insert has a grease hole (not shown) there through. The terminus of each of the slide mounting brackets has a threaded rearward adjustment block mounting hole 54 therein. Each terminus of the slide mounting brackets has at least one threaded grease fitting hole (not shown) therethrough, with an associated grease fitting 56 threadedly coupled thereto.

There is a pair of right slide bolts 58 which slidably couple the right transom mounting bracket and the right slide mounting bracket.

There is a pair of left slide bolts (not shown) which slidably couple the left transom mounting bracket and the left slide mounting bracket.

The plurality of slide bolts slidably couples the right transom mounting bracket and the right slide mounting bracket, the plurality of slide bolts also slidably couples the left transom mounting bracket and the left slide mounting bracket.

There is a slide plate 60. The slide plate has a rectilinear configuration. The slide plate has a top edge 62, a bottom edge 64, and a pair of side edges 66. The side edges of the slide plate each have a stepped 68 configuration. The slide plate has a pair of ram bracket holes (not shown) therethrough, with the ram bracket holes being located generally midway between the side edges. The ram bracket holes are also adjacent the top edge of the slide plate.

By adjacent the top edge is meant that the bracket holes are located near the top edge, between about three fourths of an inch and three inches from the top edge of the slide plate.

The slide plate having a plurality of motor mount bolt holes 70 there through. The side edges of the slide plate are sized to fit within the nylon groove insert. The slide plate has an associated lift distance marker 72. The lift distance marker has a plurality of indicia 74 thereon. The slide plate has a pair of slide plate stop bolt holes 76 therethrough.

There is a slide plate stop 80. The slide plate stop has a generally rectilinear configuration with a top surface 82 and a bottom surface 84, with a height there between. The slide plate stop has a pair of side surfaces 86 with a thickness there between. The slide plate stop has a forward surface 88 and a rearward surface (not shown), with a length there between. The rearward surface of the slide plate stop has a pair of threaded bolt holes 90 therein. The slide plate stop has a pair of associated slide plate stop bolts 92. The slide plate stop bolts couple the slide plate stop to the slide plate.

There is an upper rearward cross member 94. The upper rearward cross member has a generally round solid tubular configuration with a right end and a left end. The right end of the upper rearward cross member and the left end of the upper rearward cross member each have a threaded bolt hole therein (not shown), with each end of the upper rearward cross member having an associated bolt 96. The upper rearward cross member fixedly couples the right slide mounting bracket and the left slide mounting bracket.

There is a lower rearward cross member 98. The lower rearward cross member has a generally round solid tubular configuration, with a right end and a left end. The right end of the lower rearward cross member and the left end of the lower rearward cross member each have a threaded bolt hole (not shown) therein, with each end of the lower rearward cross member having an associated bolt 100. The lower rearward cross member fixedly couples the right slide mounting bracket and the left slide mounting bracket.

There is an upper forward cross member 102. The upper forward cross member has a generally rectangular solid tubular configuration with a right end and a left end. The right end of the upper forward cross member and the left end of the upper forward cross member each have a threaded bolt hole (not shown) therein, with each end of the upper forward cross member having an associated bolt 104. The upper forward cross member fixedly couples the right slide mounting bracket and the left slide mounting bracket.

There is a lower forward cross member 106. The lower forward cross member has a generally rectangular solid tubular configuration with a right end and a left end. The right end of the lower forward cross member and the left end of the lower forward cross member each have a threaded bolt hole (not shown) therein, with each end of the lower forward cross member having an associated bolt 108. The lower forward cross member fixedly couples the right slide mounting bracket and the left slide mounting bracket. The lower forward cross member has a hydraulic cylinder base mounting hole there through.

There is a right forward adjustment block 110 and a left forward adjustment block 112. Each forward adjustment block has a generally solid rectangular configuration with an inward side 114, an outward side 116, a forward side 118, a rearward side 120, a top side 122, and a bottom side 124. Each of the forward adjustment blocks has a pair of bolt holes 126 running from the inward side to the outward side. Each bolt hole has an associated bolt 128 coupling each of the forward adjustment blocks to one of the transom mounting brackets. Each forward adjustment block has an aperture 130 running from the forward side to the rearward side.

There is a right rearward adjustment block 132 and a left rearward adjustment block 134. Each rearward adjustment block has a generally solid rectangular configuration with an inward side 136, an outward side 138, a forward side 140 a rearward side 142, a top side 144, and a bottom side 146. Each of the rearward adjustment blocks has a bolt hole 148 running from the inward side to the outward side therethrough with the bolt hole having an associated bolt 150 coupling each of the rearward adjustment blocks to one of the terminus of each of the slide plate mounting brackets. Each rearward adjustment block has a threaded bolt hole 152 in the forward side.

There is a right adjustment rod 154 and a left adjustment rod 156. Each adjustment rod has a first threaded end 158, with the first threaded end of each adjustment rod being sized to be threadedly mated with and received by the threaded bolt hole of each of the rearward adjustment blocks. The first threaded end of each adjustment rod has an associated lock nut 160. The right adjustment rod and the left adjustment rod each have a second threaded end 162. The threaded second end of each adjustment rod is sized to slidably pass through the aperture of each of the forward adjustment blocks. The second end of each adjustment rod has a pair of associated lock nuts 164. The right adjustment rod operatively couples the right rearward adjustment block and the right forward adjustment block. The left adjustment rod operatively couples the left rearward adjustment block and the left forward adjustment block. Each adjustment rod has a length between the first end and the second end.

There is a hydraulic ram bracket 166 having a generally C-shaped configuration. The ram bracket has a rearward portion 168 and a pair of generally parallel side portions 170. The side portions of the ram bracket each have a ram pin hole 172 there through. The rearward portion of the ram bracket has a pair of bolt holes there through (not shown), with a pair of associated bolts (not shown). The ram bracket is coupled to the slide plate.

Lastly, there is a hydraulic cylinder 180. The hydraulic cylinder has a base 182 and a ram 184/. The hydraulic cylinder base is operatively coupled to the lower forward cross member. The hydraulic ram is operatively coupled to the hydraulic ram bracket and the slide plate.

The hydraulic cylinder has an associated power supply, pump, connecting pressure line, and control valve, all of which are well known in the art, but not shown herein.

In operation, the user attaches the jack plate to a boat hull having a transom. The user then attaches an outboard motor to the jack plate. The user then adjusts the forward and rearward positioning of the mounted motor, relative to the transom. This is done to increase the efficiency of the motor by moving the motor away from the water near the boat hull, where cavitation may occur, to undisturbed water away from the boat's hull.

The adjustment is made by loosening the right and left slide bolts. The user then loosens the lock nuts on the second end of each of the adjusting rods. The user then uses the locknuts to move the slide mounting brackets until the slide mounts are in the desired location. The user then locks the lock nuts on the adjusting rods, and then tightens the right and left slide bolts. Once the outboard motor is located in the desire location, the user may then also raise and lower the motor using the hydraulic jack plate.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An extending jack plate, comprising, in combination:

a right transom mounting bracket and a left transom mounting bracket;

a right slide mounting bracket and a left slide mounting bracket, with the right slide mounting bracket slidably coupled to the right transom mounting bracket and the left slid mounting bracket slidably coupled to the left transom mounting bracket;

a slide plate having a generally rectilinear configuration, the slide plate having a top edge and a bottom edge and a pair of side edges, the slide plate slidably coupled to the right slide mounting bracket and a left slide mounting bracket;

a right forward adjustment block right coupled to the right transom mounting bracket and a left forward adjustment block coupled to the left transom mounting bracket;

a right rearward adjustment block coupled to the right slide mounting bracket and a left rearward adjustment block coupled to the left slide mounting bracket; and a right adjustment rod coupling the right forward adjustment block and the right rearward adjustment block, and a left adjustment rod coupling the left forward adjustment block and the left rearward adjustment block.

2. The extending jack plate as described in claim 1, with the extending jack plate further comprising:

an upper rearward cross member coupling the right slide mounting bracket and a left slide mounting bracket;

a lower rearward cross member coupling the right slide mounting bracket and a left slide mounting bracket;

an upper forward cross member coupling the right slide mounting bracket and a left slide mounting bracket;

a lower forward cross member coupling the right slide mounting bracket and a left slide mounting bracket;

each transom mounting bracket being an approximate mirror image of the other; and each slide mounting bracket being an approximate mirror image of the other.

3. The extending jack plate as described in claim 2, with the extending jack plate further comprising:

the forwardly disposed portion of each of the slide mounting brackets having a generally rectilinear configuration;

the side edges of the slide plate each having a stepped configuration;

the upper rearward cross member having a generally round solid tubular configuration with a right end and a left end;

the lower rearward cross member having a generally round solid tubular configuration with a right end and a left end;

the upper forward cross member having a generally rectangular solid tubular configuration with a right end and a left end;

the lower forward cross member having a generally rectangular solid tubular configuration with a right end and a left end;

a hydraulic ram bracket having a generally C-shaped configuration; and a hydraulic cylinder having a base and a ram.

4. The extending jack plate as described in claim 3, with the extending jack plate further comprising:

each transom mounting bracket having a generally L-shaped configuration having an inwardly disposed transom contact portion and each transom mounting bracket having a rearwardly disposed slide plate mount coupling portion;

each slide mounting bracket having a forwardly disposed portion and each slide mounting bracket having a rearwardly disposed terminus;

each forward adjustment block having a generally solid rectangular configuration with an inward side and an outward side and a forward side and a rearward side and a top side and a bottom side;

with each rearward adjustment block having a generally solid rectangular configuration with an inward side and an outward side and a forward side and a rearward side and a top side and a bottom side;

each adjustment rod having a first threaded end; and the hydraulic cylinder base being operatively coupled to the lower forward cross member and 2 the hydraulic ram being operatively coupled to the hydraulic ram bracket and the slide plate.

5. The extending jack plate as described in claim 4, with the extending jack plate further comprising:

the right end of the upper rearward cross member and the left end of the upper rearward cross member each having a threaded bolt hole therein;

the right end of the lower rearward cross member and the left end of the lower rearward cross member each having a threaded bolt hole therein;

the right end of the upper forward cross member and the left end of the upper forward cross member each having a threaded bolt hole therein; and the right end of the lower forward cross member and the left end of the lower forward cross member each having a threaded bolt hole therein.

6. The extending jack plate as described in claim 5, with the extending jack plate further comprising:

each slide plate mount coupling portion having a plurality of slide lock bolt holes there through;

each slide plate bracket having a plurality of slide slots therethrough;

the slide plate having a pair of ram bracket holes therethrough;

each end of the upper rearward cross member having an associated bolt;

each end of the lower rearward cross member having an associated bolt;

each end of the upper forward cross member having an associated bolt;

each end of the lower forward cross member having an associated bolt; and the ram bracket having a rearward portion and a pair of generally parallel side portions.

7. The extending jack plate as described in claim 6, with the extending jack plate further comprising:

a plurality of stepped forward adjustment block mounting bolt holes therein;

each of the forwardly disposed portions of each of the slide mounting brackets having an upper forward cross member bolt hole there through and an upper rearward cross member bolt hole therethrough;

a plurality of slide bolts slidably coupling the right transom mounting bracket and the right slide mounting bracket, the slide bolts also slidably coupling the left transom mounting bracket and the left slide mounting bracket;

the ram bracket holes being located generally midway between the side edges and adjacent the top edge of the slide plate; and a slide plate stop having a generally rectilinear configuration with a top surface and a bottom surface with a height there between and a pair of side surfaces with a thickness there between and a forward surface and a rearward surface with a length there between.

8. The extending jack plate as described in claim 7, with the extending jack plate further comprising:

the upper rearward cross member fixedly coupling the right slide mounting bracket and the left slide mounting bracket;

the lower rearward cross member fixedly coupling the right slide mounting bracket and the left slide mounting bracket;

the upper forward cross member fixedly coupling the right slide mounting bracket and the left slide mounting bracket;

the lower forward cross member fixedly coupling the right slide mounting bracket and the left slide mounting bracket;

each of the forward adjustment blocks having a pair of bolt holes running from the inward side to the outward side with each bolt hole having an associated bolt coupling each of the forward adjustment blocks to one of the transom mounting brackets; and each of the rearward adjustment blocks having a bolt hole running from the inward side to the outward side therethrough with the bolt hole having an associated bolt coupling each of the rearward adjustment blocks to one of the terminus of each of the slide plate mounting brackets.

9. The extending jack plate as described in claim 8, with the extending jack plate further comprising:

each of the forwardly disposed portions of each of the slide mounting brackets having a lower forward cross member bolt hole there through and a lower rearward cross member bolt hole there through;

each terminus of the slide mounting brackets having a threaded rearward adjustment block mounting hole therein;

the slide plate having a plurality of motor mount bolt holes there through;

the rearward surface of the slide plate stop having a pair of threaded bolt holes therein; and the lower forward cross member having a hydraulic cylinder base mounting hole there through.

10. The extending jack plate as described in claim 9, with the extending jack plate further comprising:

each forward adjustment block having an aperture running from the forward side to the rearward side;

each rearward adjustment block having a threaded bolt hole in the forward side;

the first threaded end of each adjustment rod being sized to be threadedly mated with and received by the threaded bolt hole of each of the rearward adjustment blocks; and the side portions of the ram bracket each having a ram pin hole there through.

11. The extending jack plate as described in claim 10, with the extending jack plate further comprising:

the rearwardly disposed terminus of each of the slide mounting brackets being a generally mirror image of the other;

the slide plate stop having a pair of associated slide plate stop bolts, the slide plate stop bolts coupling the slide plate stop to the slide plate; and the first threaded end of each adjustment rod having an associated lock nut.

12. The extending jack plate as described in claim 11, with the extending jack plate further comprising:

each slide plate mount coupling portion having a rearward extent;

each terminus of the slide mounting brackets having a slide plate groove therein;

the right adjustment rod and the left adjustment rod each having a second threaded end, with the threaded second end of each adjustment rod being sized to slidably pass through the aperture of each of the forward adjustment blocks; and the rearward portion of the ram bracket having a pair of bolt holes there through, with a pair of associated bolts.

13. The extending jack plate as described in claim 12, with the extending jack plate further comprising:

with each slide plate groove having an associated nylon groove insert therein;

the side edges of the slide plate being sized to fit within the nylon groove insert; and the second end of each adjustment rod having a pair of associated lock nuts.

14. The extending jack plate as described in claim 13, with the extending jack plate further comprising:

the nylon groove insert having a generally C-shaped configuration;

the slide plate having an associated lift distance marker;

the right adjustment rod operatively coupling the right rearward adjustment block and the right forward adjustment block, the left adjustment rod operatively coupling the left rearward adjustment block and the left forward adjustment block; and the ram bracket the ram bracket bolts coupling the hydraulic ram bracket to the slide plate.

15. The extending jack plate as described in claim 14, with the extending jack plate further comprising:

each nylon insert having a grease hole there through;

the lift distance marker having at least one indicia thereon; and each adjustment rod having a length between the first end and the second end.

16. The extending jack plate as described in claim 15, with the extending jack plate further comprising:

each terminus of the slide mounting brackets having at least one threaded grease fitting hole therethrough with an associated grease fitting threadedly coupled thereto; and the slide plate having a pair of slide plate stop bolt holes.

17. The extending jack plate as described in claim 1, with the extending jack plate further comprising at least one cross member coupling the right slide mounting bracket and a left slide mounting bracket.

18. The extending jack plate as described in claim 17, with the extending jack plate further comprising the right slide plate mounting bracket and the left slide plate mounting bracket each having a groove therein.

19. The extending jack plate as described in claim 18, with the extending jack plate further comprising the slide plate groove of the right and left mounting brackets each having a nylon insert therein, the nylon insert holding the side edges of the slide plate.

20. The extending jack plate as described in claim 19, with the extending jack plate further comprising a slide plate stop, the travel stop being coupled to the slide plate.

21. The extending jack plate as described in claim 20, with the extending jack plate further comprising a hydraulic cylinder having a base and a ram, the base being coupled to the cross member and the ram being coupled to the slide plate.

* * * * *